US008371867B2

(12) United States Patent
Cao et al.

(10) Patent No.: US 8,371,867 B2
(45) Date of Patent: Feb. 12, 2013

(54) ILLUMINATION DEVICE WITH A CONNECTOR HAVING A RETAINER WITH A ROTARY MEMBER AND ELASTIC PIECES

(75) Inventors: Qing-Shan Cao, Shenzhen (CN); Zheng-Nian Liu, Shenzhen (CN); Jian-Pu Chen, Shenzhen (CN); Jiang-Fan Qiu, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/301,800

(22) Filed: Nov. 22, 2011

(65) Prior Publication Data

US 2013/0003367 A1 Jan. 3, 2013

(51) Int. Cl.
*H01R 33/02* (2006.01)

(52) U.S. Cl. ..... 439/226

(58) Field of Classification Search ..... 439/226, 439/13; 362/228, 254, 394, 217.14, 240
See application file for complete search history.

(56) References Cited

U.S. PATENT DOCUMENTS

| | | | | |
|---|---|---|---|---|
| 6,113,408 | A * | 9/2000 | Burwell et al. | 439/226 |
| 6,193,534 | B1 * | 2/2001 | Burwell et al. | 439/226 |
| 6,443,769 | B1 * | 9/2002 | Nerone et al. | 439/612 |
| 7,249,865 | B2 * | 7/2007 | Robertson | 362/228 |
| 7,556,396 | B2 * | 7/2009 | Kuo et al. | 362/217.01 |
| 7,946,729 | B2 * | 5/2011 | Ivey et al. | 362/254 |
| 8,033,858 | B1 * | 10/2011 | Chen | 439/419 |
| 8,319,433 | B2 * | 11/2012 | Lin et al. | 315/77 |
| 2009/0122543 | A1 * | 5/2009 | Kuo et al. | 362/240 |
| 2011/0188238 | A1 * | 8/2011 | Cao et al. | 362/217.14 |
| 2012/0051037 | A1 * | 3/2012 | Lin et al. | 362/217.14 |

* cited by examiner

*Primary Examiner* — Chandrika Prasad
(74) *Attorney, Agent, or Firm* — Altis Law Group, Inc.

(57) ABSTRACT

An illumination device includes a light tube holder including two connectors for receiving either a light-emitting diode (LED) tube or a fluorescent tube. One of the connectors includes a rotary member rotatably received in a through hole defined in a retainer, and three conductive elastic pieces positioned in the retainer around the through hole. One conductive piece is electrically connected to an LED tube drive circuit board and a fluorescent tube drive circuit board, and the other two conductive pieces are electrically connected to the LED and fluorescent tube drive circuit boards, respectively. The rotary member can be rotated to first and second positions, wherein at the first position, the LED tube can be activated, and at the second position the fluorescent tube can be activated.

7 Claims, 14 Drawing Sheets

ILLUMINATION DEVICE WITH A CONNECTOR HAVING A RETAINER WITH A ROTARY MEMBER AND ELASTIC PIECES

CROSS-REFERENCES TO RELATED APPLICATIONS

Related subject matter is disclosed in co-pending U.S. patent application Ser. Nos. 13/301,797 and a title of LIGHT TUBE HOLDER, 13/301,799 and a title of ILLUMINATION DEVICE, 13/301,801 and a title of ILLUMINATION DEVICE, 13/301,805 and a title of ILLUMINATION DEVICE, 13/301,808 and a title of ILLUMINATION DEVICE, and 13/301,810 and a title of ILLUMINATION DEVICE, which have the same assignees as the current application and were concurrently filed.

BACKGROUND

1. Technical Field

The present disclosure relates to illumination devices, and particularly, to a light-emitting diode (LED) illumination device for adapting a LED tube and a fluorescent tube.

2. Description of the Related Art

Generally, a conventional light tube holder for fluorescent tubes can not be used with LED tubes. When attempting to use an LED tube, the conventional light tube holder needs to be replaced. It is desirable and useful if a light tube holder can adapt to both fluorescent tubes and LED tubes.

Therefore, there is room for improvement within the art.

BRIEF DESCRIPTION OF THE DRAWINGS

The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
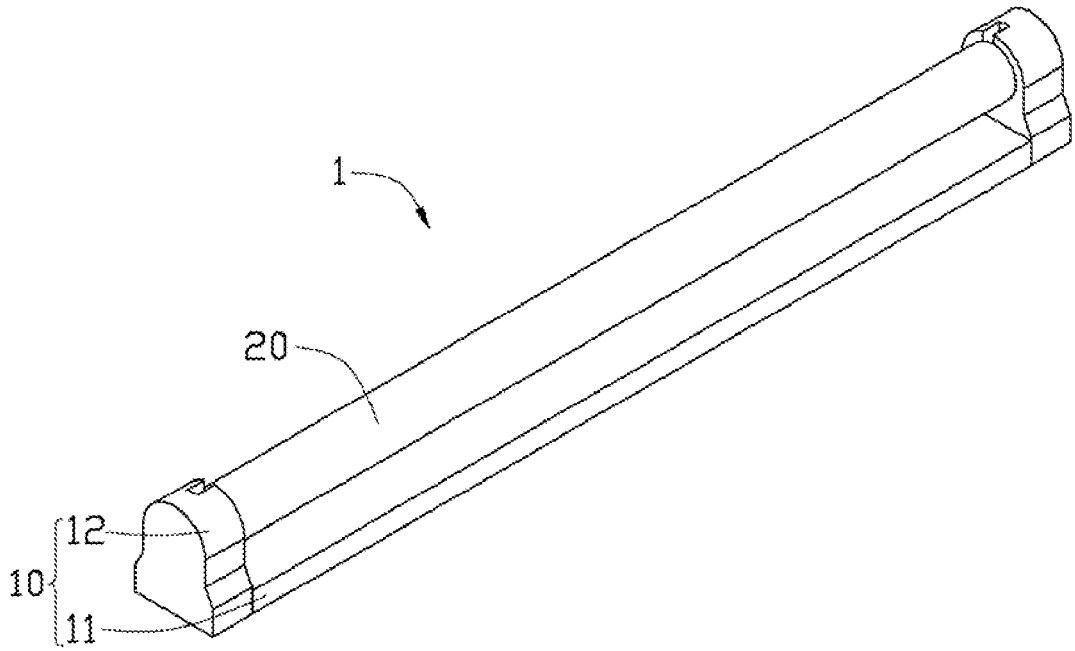
FIG. 1 is an isometric view of an illuminating device in accordance with an exemplary embodiment.
Figure 2:
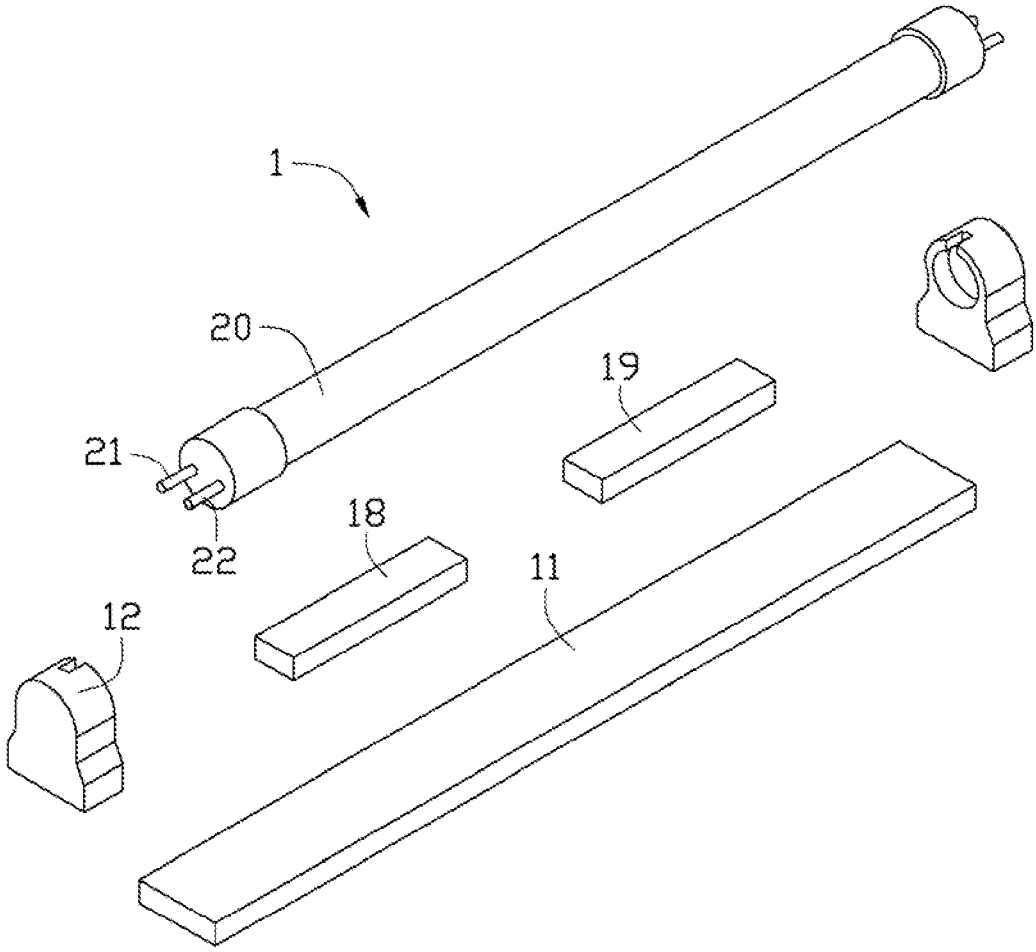
FIG. 2 is an exploded view of the illuminating device in FIG. 1.
Figure 3:
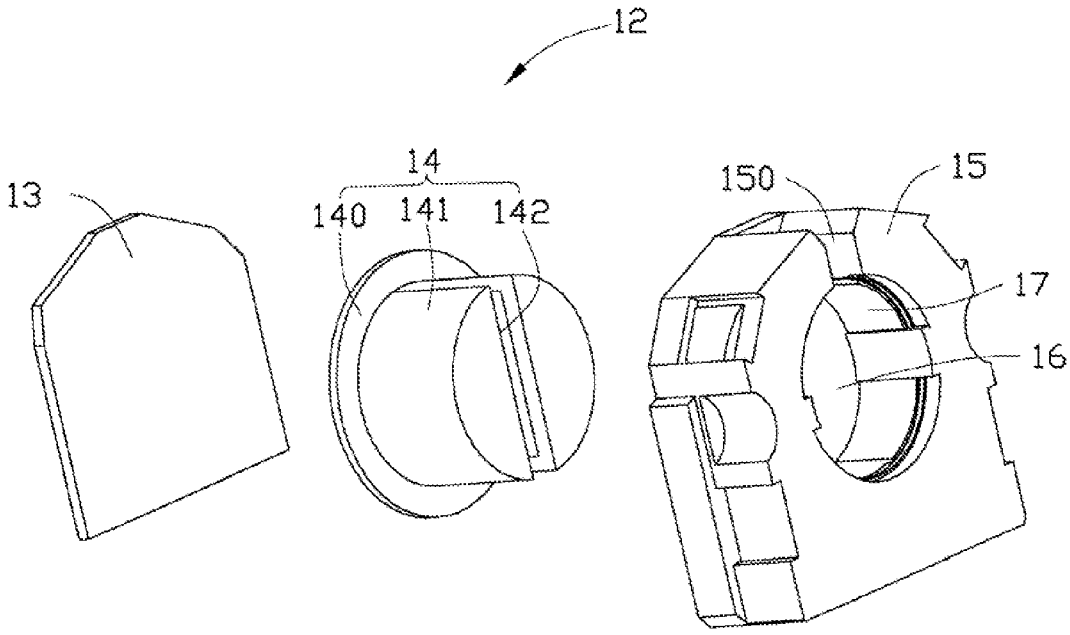
FIG. 3 is an exploded view of a connector of the illuminating device in FIG. 1.

Referring to FIGS. 1-3, an illuminating device 1 includes a tube holder 10 and a tube 20 mounted on the tube holder 10. The tube 20 in FIGS. 1 and 2 is a light-emitting diode (LED) tube 20. A conductive pin 21 and an insulated pin 22 are arranged on each end of the LED tube 20. A conductive pine 21 at one end is diagonally opposite to the other conductive pin 21 on the other end of the LED tube 20. The tube 20 also can be a traditional fluorescent tube which has two conductive pins on one end thereof and two conductive pins on an opposite end thereof.

The tube holder 10 includes a base 11 and connectors 12 at opposite ends of the base 11. Each connector 12 includes a cap 13, a retainer 15, and a rotary member 14. The cap 13 is attached to one end of the retainer 15. The cap 13 and the retainer 15 cooperatively define a space to receive the rotary member 14 therein. In the embodiment, a through hole 16 is defined in the retainer 15. The rotary member 14 is smaller in diameter than the though hole 16, thereby allowing the rotary member 14 to be received and to rotate in the through hole 16. The rotary member 14 is in the shape of a hat, including a brim 140, a body 141, and a first groove 142. The brim 140 is larger in diameter than the though hole 16, and abuts the outside end face of the retainer 15 around the though hole 16. The first groove 142 is diametrically defined in the body 141 and divides the body 141 into two substantially equal parts. The first groove 142 can receive the two pins of the tube 20 therein. An opening 150 is defined in the retainer 15, on a line substantially perpendicular to, and furthest from, the base 11, and extends from an external surface of the sidewall of the through hole 16, and communicates with the through hole 16.

Figure 4:
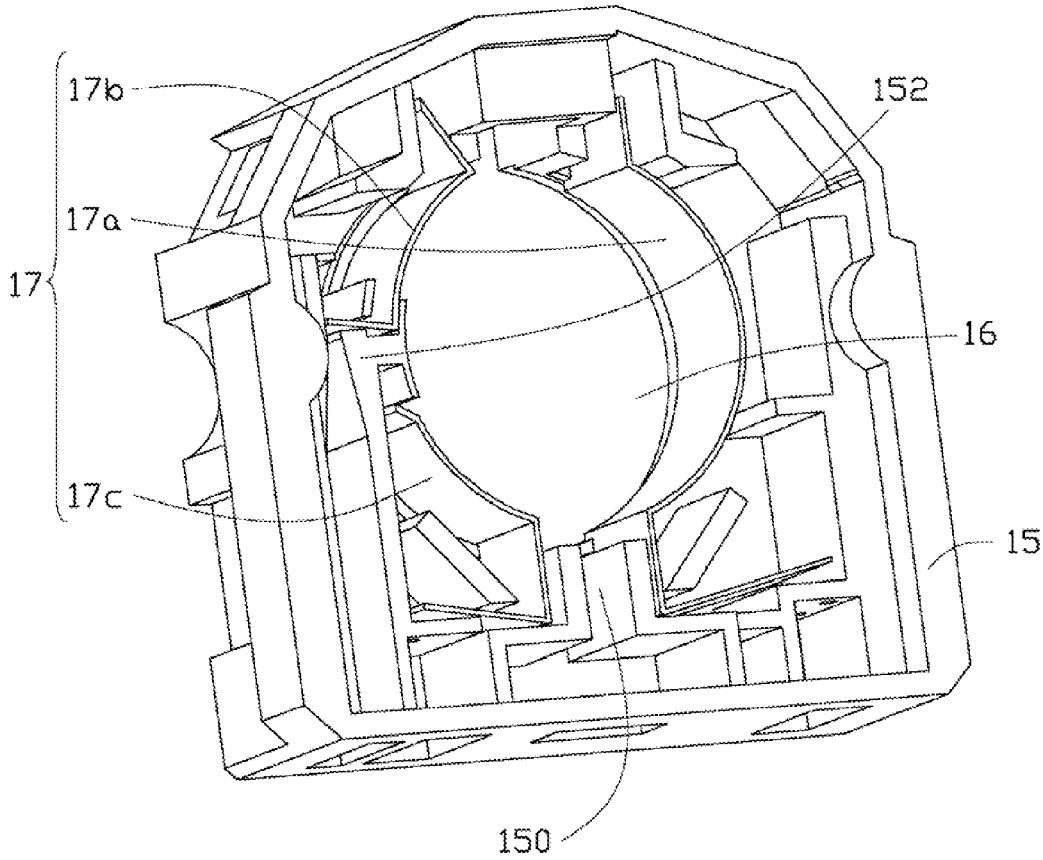
FIG. 4 is an isometric view of a retainer of the connector of the illuminating device in FIG. 3 according to a first exemplary embodiment.

Referring to FIG. 4, an elastic member 17 consisting of three elastic pieces 17*a*, 17*b*, 17*c* is positioned in the retainer 15 around the through hole 16. Each elastic piece 17*a*, 17*b*, 17*c* is made of an elastic metal sheet by stamping. The elastic piece 17*a* has a configuration of a half of a circle, while each of the elastic pieces 17*b*, 17*c* has a configuration of one fourth of a circle. A second groove 151 is defined in the retainer 15 opposite the opening 150. In this embodiment, at least one buffer pad 152 is formed on the side wall between the opening 150 and the second groove 151. The opening 150, the second groove 151, and the at least one buffer pad 152 are used to separate the three elastic pieces 17*a*, 17*b*, 17*c* of the elastic member 17 from each other. The three elastic pieces 17*a*, 17*b*, 17*c* of the elastic member 17 can then be electrically insulated from each other. The tube holder 10 further includes a LED tube drive circuit board 18 and a fluorescent tube drive circuit board 19 mounted in the base 11. The elastic pieces 17*a*, 17*b* are connected to the LED tube drive circuit board 18 and the elastic pieces 17*a*, 17*c* are connected to the fluorescent tube drive circuit board 19.

When installing the tube 20, the rotary member 14 is first rotated to cause the first groove 142 to align with the opening 150. The pins 21 of the tube 20 can then be inserted into the through hole 16 and supported in the first groove 142. The tube 20 can then be rotated to misalign the first groove 142 of the rotary member 14 with the opening 150, and securely retain the tube 20 in the retainer 15.

When the tube 20 is rotated to a predetermined position (indicated by a mark (not shown) on the connector 12), the rotary member 14 is rotated to a first position where the pins 21 of the tube 20 make contact with the elastic pieces 17*a*, 17*b* of the elastic member 17. Thus, the tube 20 can be driven by the LED tube drive circuit board 18. When the element 14 is rotated to a second position, the pins 21 of the tube 20 make contact with the elastic pieces 17*a*, 17*c* of the elastic member 17, allowing the tube 20 to be driven by the fluorescent tube drive circuit board 19. By virtue of these arrangements, the tube holder 10 can well adapt to any type of the tube 20.

In the first embodiment, the elastic member 17 includes three elastic pieces 17*a*, 17*b*, and 17*c*. The length of the elastic piece 17*a* is about 0.5 A, where A represents the perimeter of the through hole 16. The lengths of the elastic pieces 17*b* and 17*c* are both 0.25 A. The number of the at least one buffer pad 152 is one. Thus, the elastic pieces 17*a*, 17*b*, and 17*c* are separated from each other by the opening 150, the second groove 151 and the buffer pad 152.

In an alternative embodiment, the elastic pieces 17*a* and 17*b* may be connected to the fluorescent tube drive circuit board 19, and the elastic pieces 17*a* and 17*c* may be connected to the LED tube drive circuit board 18.

Figure 5:
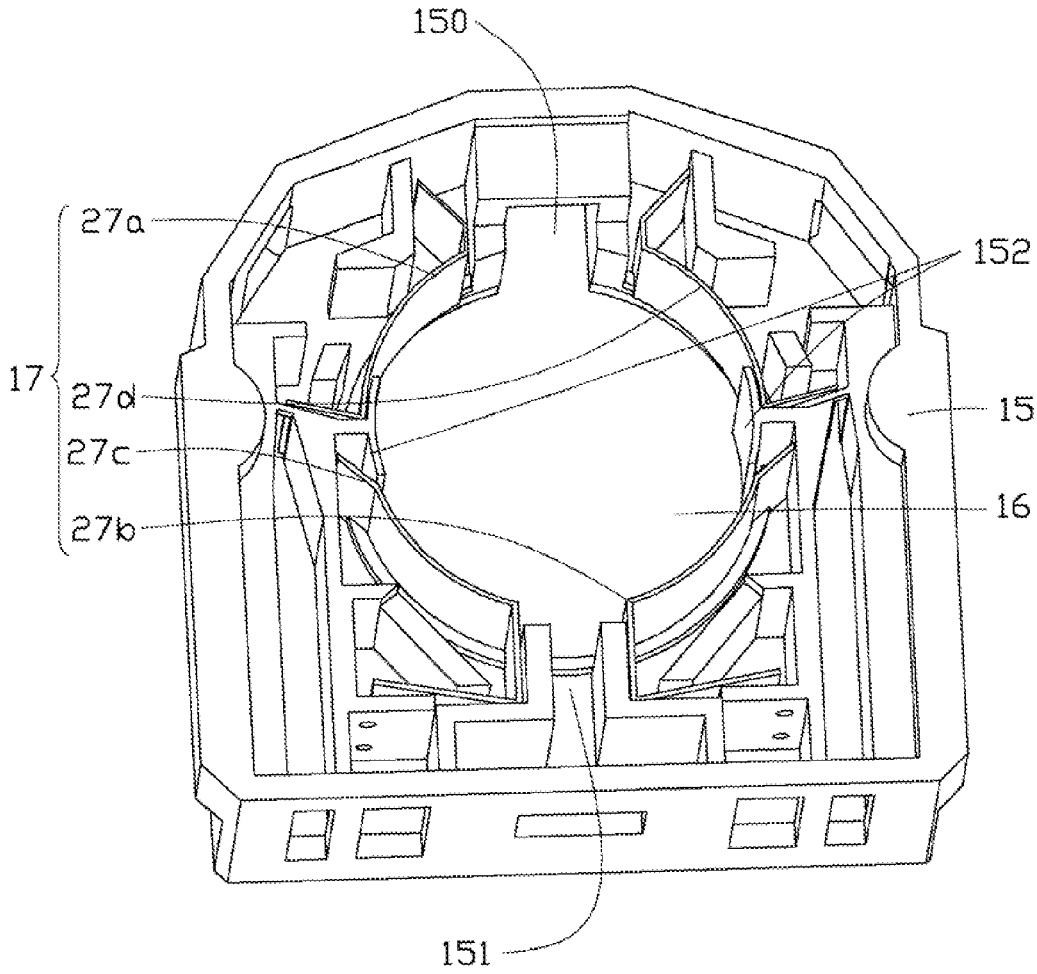
FIG. 5 is an isometric view of the retainer of the connector of the illuminating device in FIG. 3 according to a second exemplary embodiment.

Referring to FIG. 5, in a second embodiment, there are four elastic pieces 27*a*, 27*b*, 27*c*, and 27*d* constituting the elastic member 17. The lengths of the four elastic pieces 27*a*, 27*b*, 27*c*, and 27*d* are all 0.25 A. The number of the at least one buffer pad 152 is two. Thus, the elastic pieces 27*a*, 27*b*, 27*c*, and 27*d* are separated from each other by the opening 150, the second groove 151 and the two buffer pads 152.

In the embodiment, the elastic pieces 27*a* and 27*b* are connected to the LED tube drive circuit board 18, and the elastic pieces 27*c* and 27*d* are connected to the fluorescent tube drive circuit board 19. The first position mentioned above is the position where the pins 21 of the tube 20 stay in contact with the elastic pieces 27*a* and 27*b*, and the second position mentioned above is the position where the pins 21 of the tube 20 stay in contact with the elastic pieces 27*c* and 27*d*.

Figure 6:
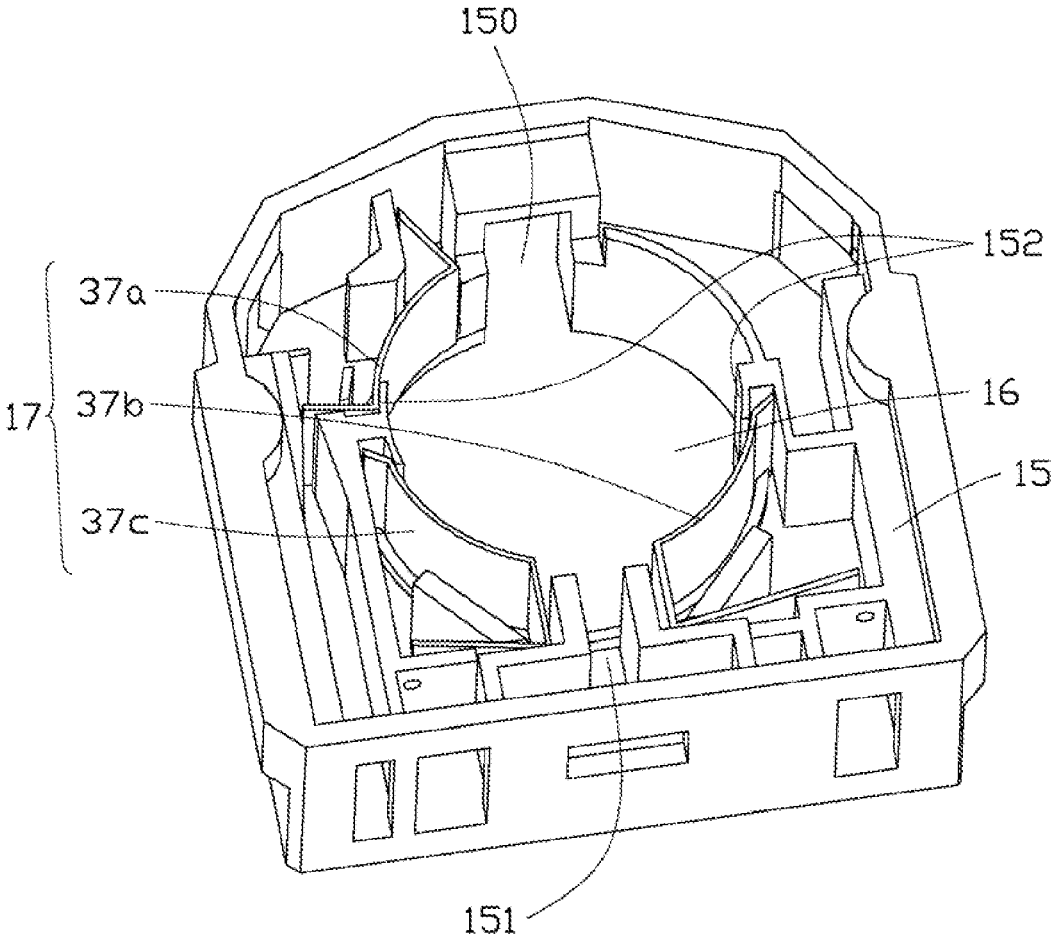
FIG. 6 is an isometric view of the retainer of the connector of the illuminating device in FIG. 3 according to a third exemplary embodiment.

Referring to FIG. 6, in a third embodiment, there are three elastic pieces 37*a*, 37*b* and 37*c* constituting the elastic member 17. The lengths of the three elastic pieces 37*a*, 37*b*, and 37*c* are all 0.25 A. The number of the at least one buffer pad 152 is two. Thus, the elastic pieces 37*a*, 37*b*, and 37*c* are separated from each other by the opening 150, the second groove 151 and the two buffer pads 152.

In the embodiment, the elastic pieces 37*a* and 37*b* are connected to the fluorescent tube drive circuit board 19, and the elastic piece 37*c* is connected to the LED tube drive circuit board 18. The first position mentioned above is the position where one of the pins 21 of the tube 20 stay in contact with the elastic piece 37*c*, and the second position mentioned above is the position where the pins 21 of the tube 20 stay in contact with the elastic pieces 37*a* and 37*b*.

Figure 7:
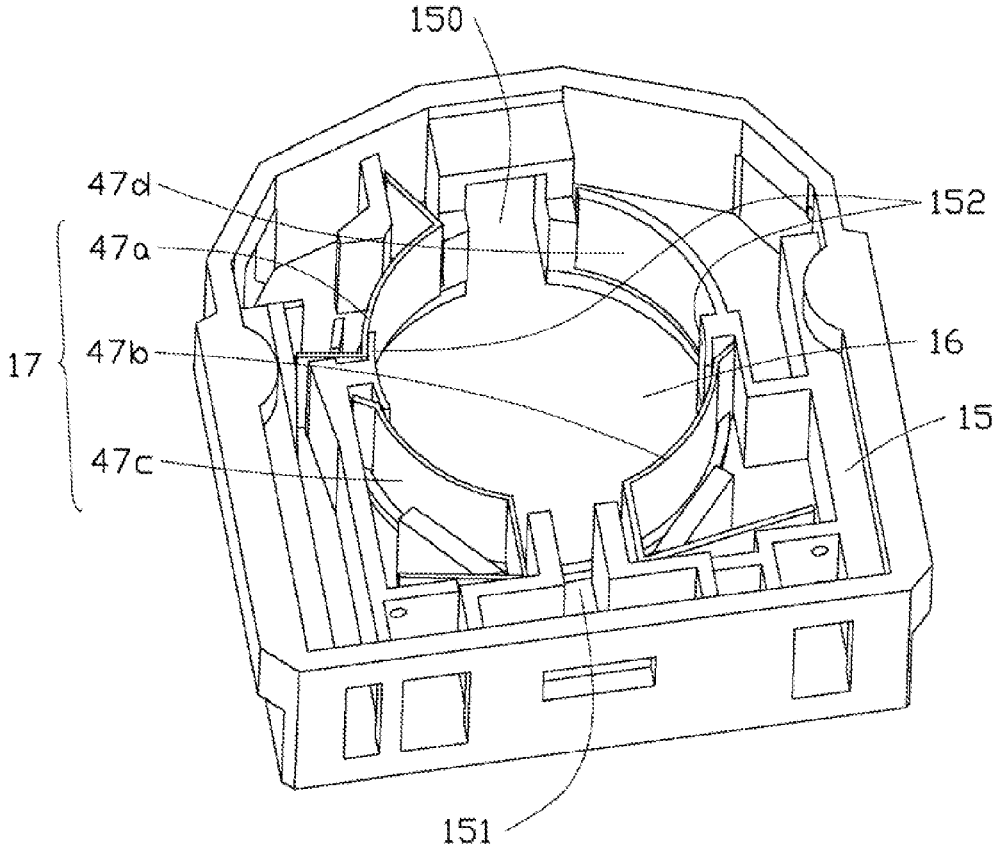
FIG. 7 is an isometric view of the retainer of the connector of the illuminating device in FIG. 3 according to a fourth exemplary embodiment.
Figure 8:
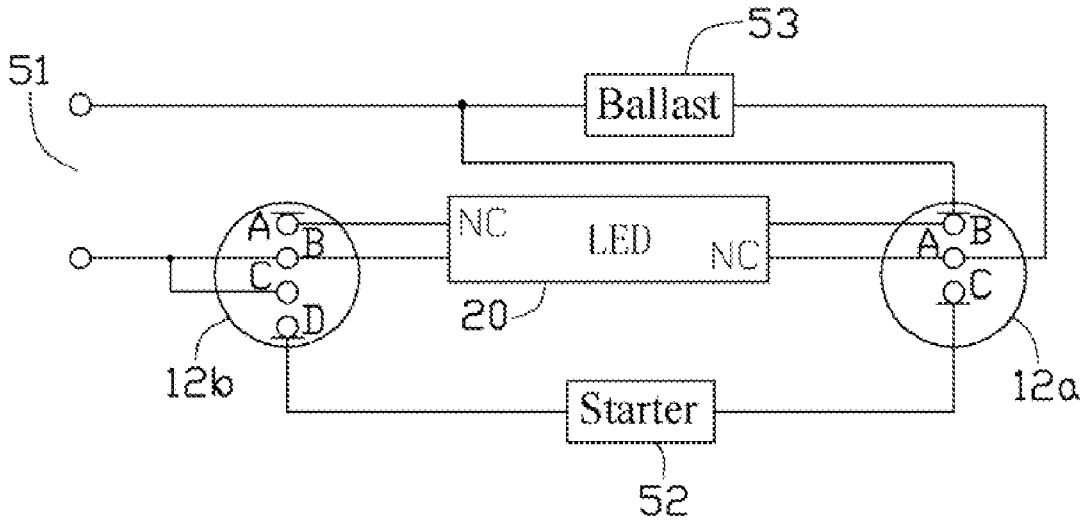
FIG. 8 is a circuit diagram of the LED illumination device in FIG. 1, illustrating a LED tube connected to the connector in FIG. 4 and the connector in FIG. 5 according to a first exemplary embodiment.
Figure 9:
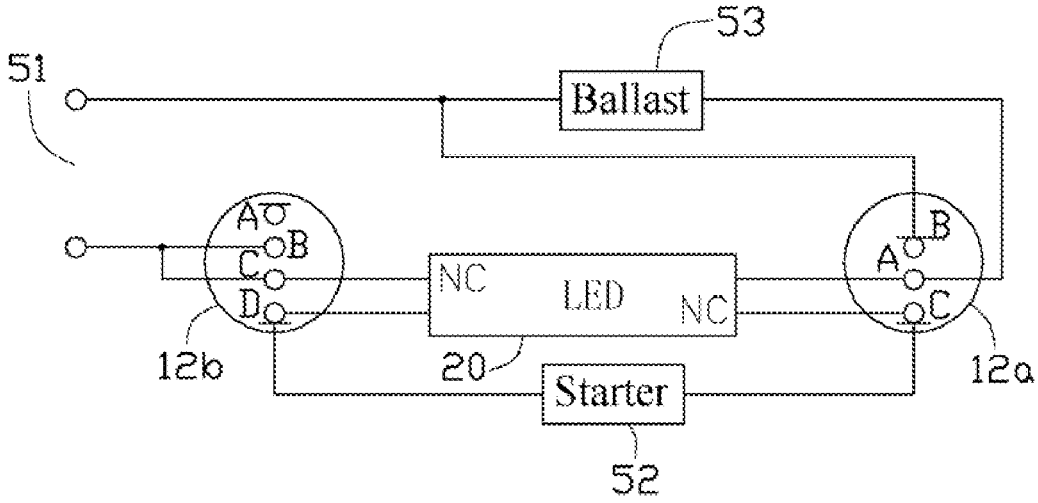
FIG. 9 is a circuit diagram of the illumination device in FIG. 1, illustrating the LED tube connected to the connector in FIG. 4 and the connector in FIG. 5 according to a second exemplary embodiment.
Figure 10:
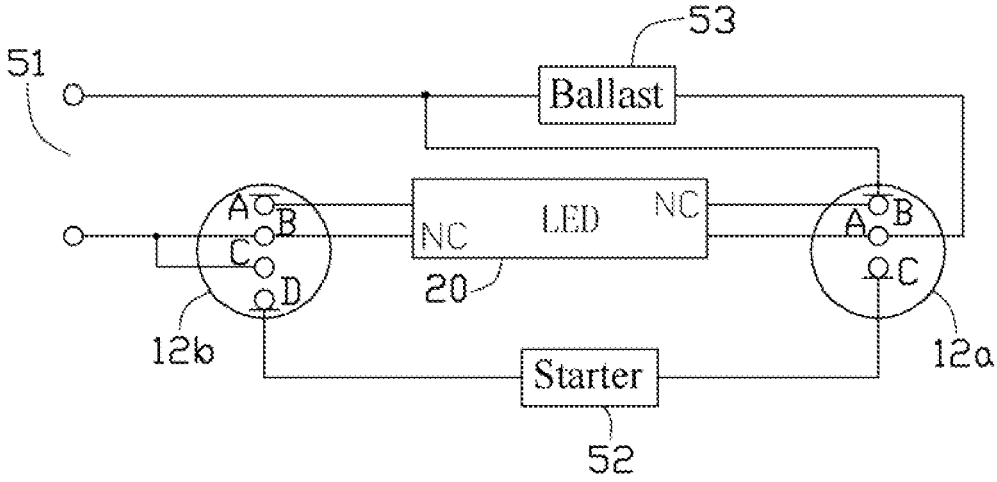
FIG. 10 is a circuit diagram of the illumination device in FIG. 1, illustrating the LED tube connected to the connector in FIG. 4 and the connector in FIG. 5 according to a third exemplary embodiment.
Figure 11:
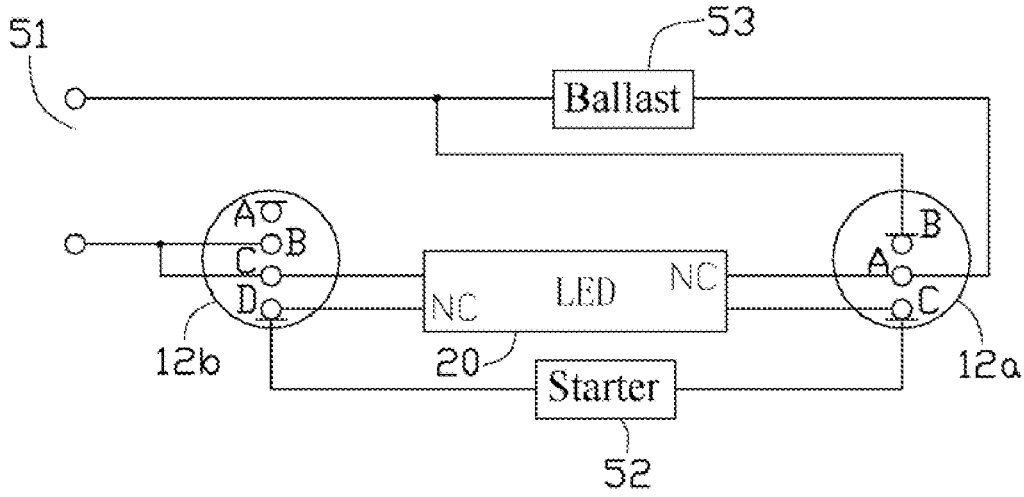
FIG. 11 is a circuit diagram of the illumination device in FIG. 1, illustrating the LED tube connected to the connector in FIG. 4 and the connector in FIG. 5 according to a fourth exemplary embodiment.

Referring to FIG. 7, in a fourth embodiment, there are three elastic pieces 47*a*, 47*b*, and 47*c* constituting the elastic member 17. The lengths of the three elastic pieces 47*a*, 47*b*, and 47*c* are all 0.25 A. An insulation piece 47*d* is positioned in the retainer 15 around the through hole 16. The insulation piece 47*d* is resilient and has a configuration of a quarter of a circle. The length of the insulation piece 47*d* is about 0.25 A. The number of the at least one buffer pad 152 is two. Thus, the elastic pieces 47*a*, 47*b*, 47*c*, and the insulation piece 47*d* are separated from each other by the opening 150, the second groove 151 and the two buffer pads 152.

When installing the tube 20, the rotary member 14 is rotated to a position where the pins 21 of the tube 20 stay in contact with the elastic piece 47*c* and the insulation piece 47*d*, the elastic piece 47*c* and the insulation piece 47*d* can tightly press against the two pins 21 of the tube 20, thereby holding the tube 20 in position.

In the embodiment, the elastic pieces 47*a* and 47*b* are connected to the fluorescent tube drive circuit board 19, and the elastic piece 47*c* is connected to the LED tube drive circuit board 18. The first position mentioned above is the position where the pins 21 of the tube 20 stay in contact with the elastic piece 47*c* and the insulation piece 47*d*, and the second position mentioned above is the position where the pins 21 of the tube 20 stay in contact with the elastic pieces 47*a* and 47*b*.

The illumination device 1 may include two connectors 12 of FIG. 4, FIG. 5, FIG. 6, or FIG. 7. Alternatively, the illumination device 1 may include one connector 12*a* of FIG. 4, and one connector 12*b* of FIG. 5 (shown in FIGS. 8-13).

Referring to FIGS. 8-11, the elastic pieces 27*b* and 27*c* of the connector 12*b* are connected to the negative terminal of a power supply 51, and the elastic piece 27*a* of the connector 12*b* is disconnected from the power supply 51, the ballast 53 and the starter 52. The elastic piece 17*a* of the connector 12*a* is connected to the positive terminal of the power supply 51 via a ballast 53, and the elastic piece 17*b* of the connector 12*a* is directly connected to the positive terminal of the power supply 51. A starter 52 is connected between the elastic piece 17*c* of the connector 12*a* and the elastic piece 27*d* of the connector 12*b*.

When installing the LED tube 20, the two pairs of pins 21 and 22 can be inserted into the though holes 16 of the connectors 12*a* and 12*b*. The LED tube 20 can be rotated, and when the LED tube 20 is rotated to the first position, the two insulated pins 22 make and stay in contact with the elastic pieces 17*a* of the connector 12*a* and the elastic piece 27*a* of the connector 12*b*, and the two conductive pins 21 make and stay in contact with the elastic piece 17*b* of the connector 12*a* and the elastic piece 27*b* of the connector 12*b*, thus allowing the two conductive pins 21 to be connected to the positive and negative terminals of the power supply 51. Thus, the LED tube 20 can be driven by the LED drive circuit board 18 (shown in FIG. 8) by a current flowing from the positive terminal of the power supply 51, the LED drive circuit board 18, the conductive pin 21 of the LED tube 20 in connection with the elastic piece 17*b* of the connector 12*a*, LEDs in the LED tube 20 and the conductive pine 21 of the LED tube 21 in connection with the elastic piece 27*b* of the connector 12*b* to the negative terminal of the power supply 51.

When the LED tube 20 is rotated to make the two conductive pins 21 stay in contact with the elastic pieces 17*a* and 27*d*, and two insulated pins 22 stay in contact with the elastic pieces 17*c* and 27*c*, this causes one of the two insulated pins 22 to be connected to the negative terminal of the power supply 51, and one of the two conductive pins 21 to be connected to the Page of positive terminal of the power supply 51 via the ballast 53. Thus, the LED tube 20 cannot be driven by the LED drive circuit board 18 (shown in FIG. 9).

When the LED tube 20 is rotated to a position to make the two conductive pins 21 stay in contact with the elastic pieces 17*a* and 27*a*, and the two insulated pins 22 stay in contact with the elastic pieces 17*b* and 27*b*, this causes one of the two insulated pins 22 to be connected to the negative terminal of the power supply 51, and one of the two conductive pins 21 to be connected to the positive terminal of the power supply 51 via the ballast 53. Thus, the LED tube 20 cannot be driven by the LED drive circuit board 18 (shown in FIG. 10).

When the LED tube 20 is rotated to a position to make the two conductive pins 21 stay in contact with the elastic pieces 17*c* and 27*c*, and two insulated pins 22 stay in contact with the elastic pieces 17*a* and 27*d*, this causes one of the two conductive pins 21 to be connected to the negative terminal of the power supply 51, and one of the two insulated pins 22 to be connected to the positive terminal of the power supply 51 via the ballast 53. Thus, the LED tube 20 cannot be driven by the LED drive circuit board 18 (shown in FIG. 11).

Figure 12:
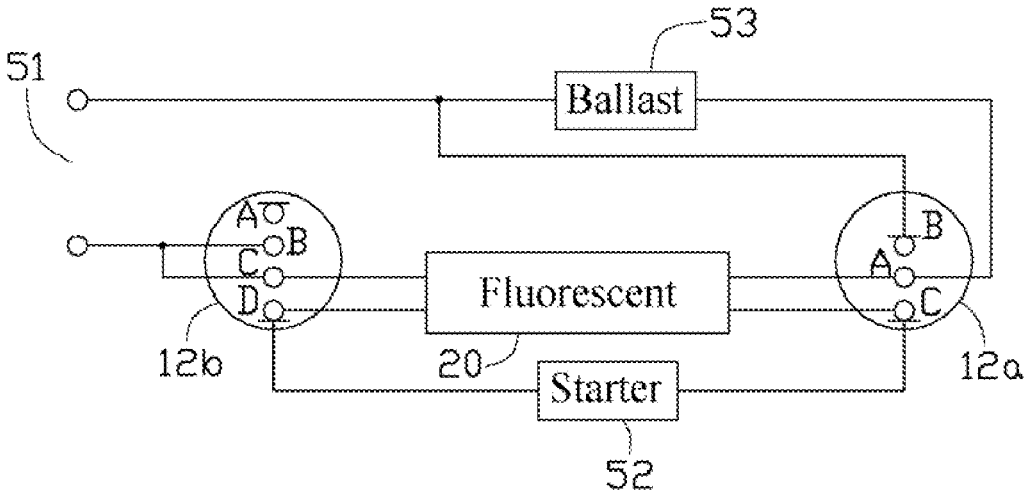
FIG. 12 is a circuit diagram of the illumination device in FIG. 1, illustrating a fluorescent tube connected to the connector in FIG. 4 and the connector in FIG. 5 according to a first exemplary embodiment.
Figure 13:
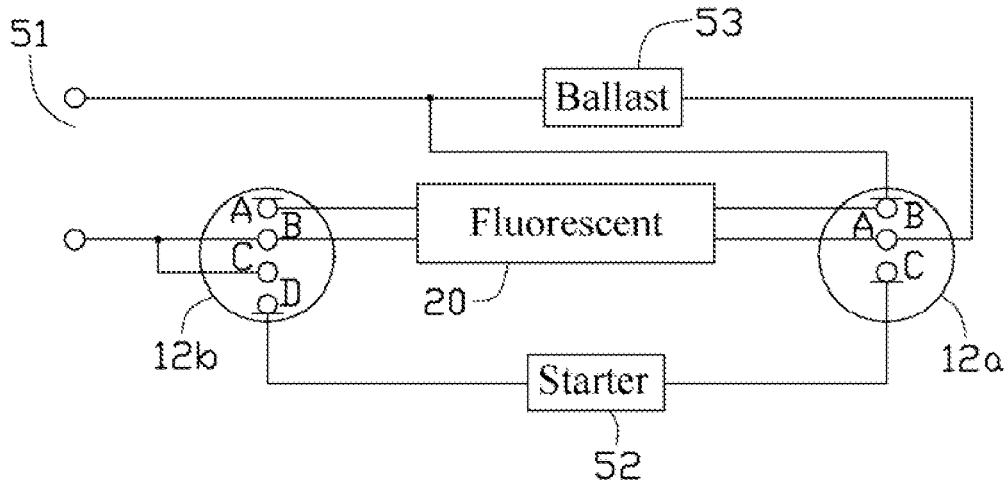
FIG. 13 is a circuit diagram of the illumination device in FIG. 1, illustrating the fluorescent tube connected to the connector in FIG. 4 and the connector in FIG. 5 according to a second exemplary embodiment.

Referring to FIGS. 12 and 13, when installing the fluorescent tube 20, the two pairs of pins can be respectively inserted into the through holes 16 of the connectors 12*a* and 12*b*. The fluorescent tube 20 can be rotated, and when the fluorescent tube 20 is rotated to the second position, the pins of the fluorescent tube 20 make and stay in contact with elastic pieces 17*a* and 17*c* of the connector 12*a* and the elastic pieces 27*c* and 27*d* of the connector 12*b*, allowing two of the pins of the fluorescent tube 20 to be connected to the positive and negative terminals of the power supply 51 respectively, wherein the pin connecting with the positive terminal of the power supply 51 is through the ballast 53. The starter 52 is connected between the other two pins of the fluorescent tube 20. Thus, the fluorescent tube 20 can be driven by the fluorescent drive circuit board 19 (shown in FIG. 12).

When the fluorescent tube 20 is rotated to a position whereby the two pairs of pins make and stay in contact with the elastic pieces 17*a* and 17*b* of the connectors 12*a* and the elastic pieces 27*a* and 27*b* of the connector 12*b*, this causes two of the pins of the fluorescent tube 20 to be connected to the positive and negative terminals of the power supply 51 respectively. But, the starter 52 is disconnected from the fluorescent tube 20. Thus, the fluorescent tube 20 cannot be driven by the fluorescent drive circuit board 19 (shown in FIG. 13).

Figure 14:
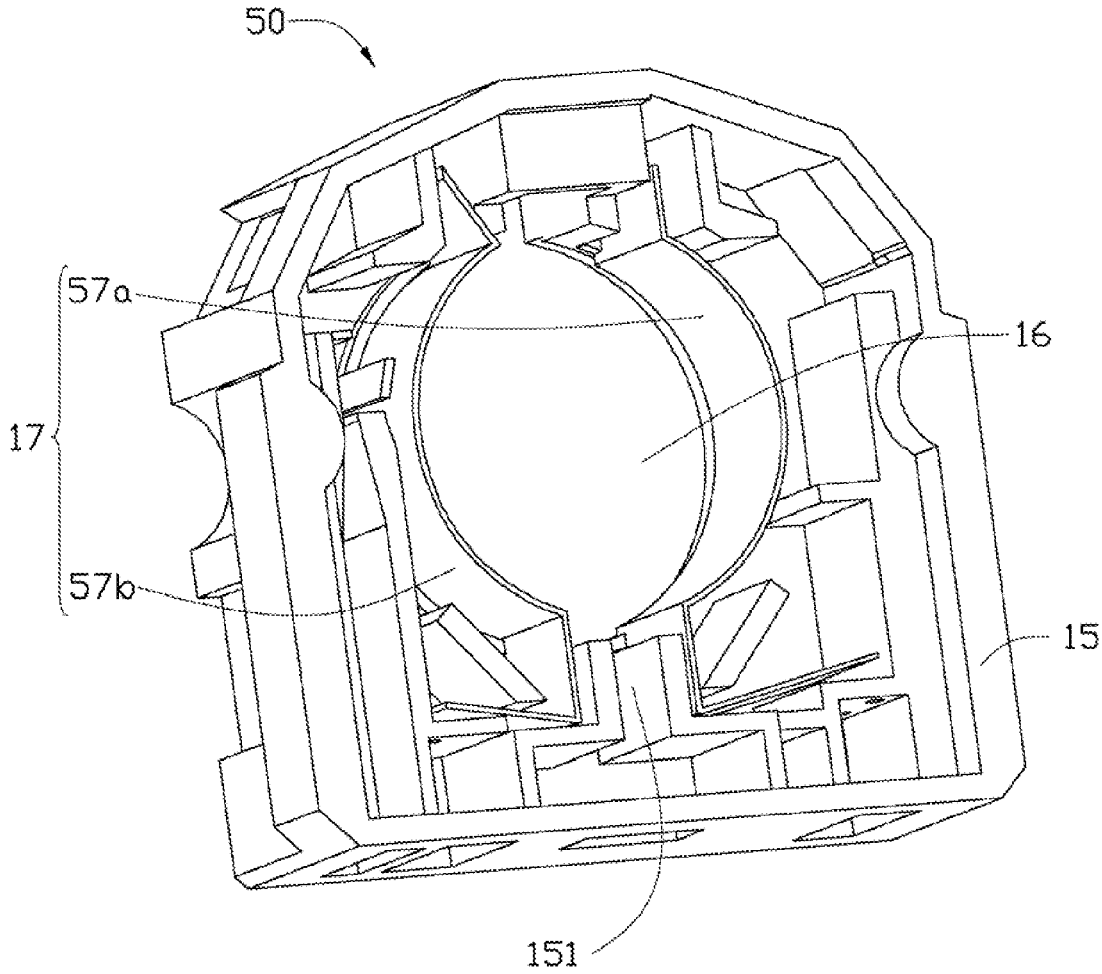
FIG. 14 is an isometric view of a connector for a conventional fluorescent tube.

FIG. 14 illustrates a connector 50 for the conventional fluorescent tube 20. Two elastic pieces 57*a* and 57*b* constituting an elastic member 17 are arranged around the through hole 16 in connector 50, and the lengths of the elastic pieces 57*a* and 57*b* are 0.5 A. The elastic pieces 57*a* and 57*b* are separated from each other by the opening 150 and by the second groove 151. The elastic pieces 57*a* and 57*b* are connected to the fluorescent tube drive circuit board 19.

The illumination device 1 may include the one connector 12 of FIG. 4 or FIG. 5 and one connector 50 of FIG. 14.

It is understood that the present disclosure may be embodied in other forms without departing from the spirit thereof. Thus, the present examples and embodiments are to be considered in all respects as illustrative and not restrictive, and the disclosure is not to be limited to the details given herein.

What is claimed is:

1. An illumination device comprising:

a light tube holder comprising:

a base;

a light-emitting diode (LED) tube drive circuit board mounted in the base;

a fluorescent tube drive circuit board mounted in the base;

first and second connectors arranged at opposite ends of the base for selectively receiving one of a fluorescent tube or an LED tube, the fluorescent tube comprising two conductive pins arranged on one end thereof and another two conductive pins arranged on an opposite end thereof, the LED tube comprising a conductive pin and an insulated pin being arranged on each end thereof, and the conductive pins arranged on opposite ends of the LED tube being diagonally opposite to each other;

wherein the first connector comprises:

a retainer defining a though hole;

a rotary member rotatably received in the through hole, and defining a first groove to receive two pins on one end of one of the tubes; and three elastic pieces positioned in the retainer around the through hole, the three elastic pieces comprising a first elastic piece, a second elastic piece and a third elastic piece, the first and second elastic pieces electrically connecting with the LED tube drive circuit board, and the first and third elastic piece electrically connecting with the fluorescent tube drive circuit board;

wherein the second connector comprises:

a retainer; and four elastic pieces comprising a fourth elastic piece, a fifth elastic piece, a sixth elastic piece and a seventh elastic piece received in the retainer of the second connector, in which the fifth and sixth elastic pieces electrically connect with a negative terminal of a power source and the seventh elastic piece electrically connects with a starter which is in turn electrically connected with the third elastic piece of the first connector, the first elastic piece being electrically connected with a positive terminal of the power source via a ballast and the second elastic piece being electrically connected with the positive terminal directly;

wherein when the rotary member of the first connector is rotated to a first position, the two pins on the one end of one of the tubes stay in contact with the first and second elastic pieces of the first connector, and the two pins on the opposite end of one of the two tubes stay in contact with the fourth elastic piece and the fifth elastic piece, respectively, and wherein when the one of the tubes is the LED tube, and the two pines on the opposite ends of the LED tube and connecting with the second and fifth terminals are the conductive pines, the LED tube is driven by the LED tube drive circuit board; and when the rotary member of the first connector is rotated to a second position, the two pins on the one end of one of the tubes stay in contact with the second elastic piece and the third elastic piece, respectively, and the two pins on the opposite end of one of the tubes stay in contact with the sixth elastic piece and the seventh elastic piece, respectively, and wherein when the one of the tubes is the fluorescent tube, the fluorescent tube is driven by the fluorescent tube drive circuit board.

2. The illumination device as recited in claim 1, wherein the each of the elastic pieces has an arced configuration.

3. The illumination device as recited in claim 1, wherein an opening is defined in the retainer of the first connector and extends from an external lateral surface to a sidewall thereof surrounding the through hole, and communicates with the through hole.

4. The illumination device as recited in claim 3, wherein the first connector further comprising:

a second groove defined in the retainer thereof opposite the opening; and at least one buffer pad formed on the side wall, between the opening and the second groove, the opening, the second groove, and the at least one buffer pad separate the first, second and third elastic pieces from each other.

5. The illumination device as recited in claim 4, wherein a length of the first elastic piece is about half of a perimeter of the through hole, and lengths of the second and third elastic pieces are both about a quarter of the perimeter of the through hole; the number of the at least one buffer pad is one; the first elastic piece, the second elastic piece, and the third elastic piece are separated from each other by the opening, the second groove and the buffer pad.

6. The LED illumination device as recited in claim 4, wherein the retainer of the second connector defines a through hole, the fourth, fifth, sixth and seventh elastic pieces are mounted around the through hole of the retainer of the second connector.

7. The LED illumination device as recited in claim 6, wherein lengths of the fourth, fifth, sixth and seventh elastic pieces are all about a quarter of the perimeter of the through hole of the retainer of the second connector.

* * * * *